US006322462B1

(12) United States Patent
Kafer

(10) Patent No.: US 6,322,462 B1
(45) Date of Patent: Nov. 27, 2001

(54) ELBOW BRACE FOR TEACHING BASEBALL THROWING

(75) Inventor: Timothy J. Kafer, Bellevue, WA (US)

(73) Assignee: Throwright LLC, Bellevue, WA (US)

( * ) Notice: Subject to any disclaimer, the term of this patent is extended or adjusted under 35 U.S.C. 154(b) by 0 days.

(21) Appl. No.: 09/432,304

(22) Filed: Nov. 2, 1999

(51) Int. Cl.[7] ..... A63B 69/00

(52) U.S. Cl. ..... 473/458; 473/207; 473/212; 473/214; 602/21; 602/79; 128/881; 128/878

(58) Field of Search ..... 473/422, 438, 473/453, 458, 207, 212–214; 128/874–876, 878–881, 892; 602/6, 60–62, 20–21, 64, 79

(56) References Cited

U.S. PATENT DOCUMENTS

| | | | | |
|---|---|---|---|---|
| D. 334,827 | * | 4/1993 | Brown | 29/121.1 |
| 802,623 | * | 10/1905 | Camp | 473/214 |
| 937,769 | * | 10/1909 | Collis | 602/64 |
| 1,070,869 | * | 8/1913 | Alexander | 602/20 |
| 2,211,203 | * | 8/1940 | Goldman | 128/881 |
| 2,559,514 | * | 7/1951 | Parker | 128/881 |
| 3,232,289 | * | 2/1966 | Zimmerman | 602/21 |
| 4,013,070 | * | 3/1977 | Harroff | 602/20 |
| 4,481,942 | * | 11/1984 | Duncan | 128/878 |
| 4,854,309 | * | 8/1989 | Elsey | 602/21 |
| 4,953,569 | * | 9/1990 | Lonardo | 128/892 |
| 5,137,508 | * | 8/1992 | Engman | 602/79 |
| 5,307,521 | * | 5/1994 | Davis | 602/23 |
| 5,618,263 | * | 4/1997 | Alivizatos | 128/878 |
| 5,695,453 | * | 12/1997 | Neal | 602/21 |
| 6,000,402 | * | 7/1998 | Able | 128/869 |

* cited by examiner

*Primary Examiner*—Jeanette Chapman
*Assistant Examiner*—Mitra Aryanpour
(74) *Attorney, Agent, or Firm*—Graybeal Jackson Haley LLP

(57) ABSTRACT

An improved elbow brace adapted for teaching baseball throwing with three stays enclosed by cloth and attached with two circumferential cloth straps. Two or more pads 21 sit between the ends of stays and the inner surface of the brace which adjoins the skin when worn. Stitched seams 15 are placed very close to the edges of the primary stays 3 and the third stay 9 to carefully hold them in proper alignment, allowing less than three-eighths of an inch of lateral movement and preferable less than one-eighth of an inch. The span between the primary stays 3 narrows toward the top of the brace 11. The middle stay is stiffer than the other two.

15 Claims, 2 Drawing Sheets

ELBOW BRACE FOR TEACHING BASEBALL THROWING

BACKGROUND OF THE INVENTION

When people with no experience first try to throw a baseball, especially children, they often cock the elbow in an undesirable fashion. Successful baseball players learn to keep the elbow straighter than 90 degrees while they throw. A coach can hold the elbow in a suitable position while a throw is practiced in slow motion, but it is impossible for a coach to hold the elbow in this position during an actual throw.

A mechanical brace for keeping the elbow in a preferred position has been developed for use in training tennis players. A diagram for the brace is shown in FIG. 1. It consists of a patch of cloth 1 with two longitudinal pockets 2 where stays 3 are inserted. The cloth 1 is strapped around the elbow with three straps 4 which attach to velcro patches 5 on the opposite edge of the cloth. Unfortunately, this brace does not adequately hold the elbow for teaching baseball throwing.

SUMMARY OF THE INVENTION

The invention is an improved elbow brace adapted for teaching baseball throwing. One of the features of the invented brace is that, in addition to the two stays 3 of the prior art, it has an additional stay 9 making a total of three stays. The additional stay 9 is preferably narrower than the other two stays 3.

The sheet of cloth 1 of the prior art brace extends around less than 50% of the circumference of the arm. However, the invented brace must achieve a significantly greater bracing effect than the prior art brace. Consequently, in one embodiment as shown in FIG. 2, it must extend around more than 50% of the circumference of the arm. However, it cannot extend around 100% of the circumference of the arm or it will produce too much chafing at the elbow. Consequently, when properly sized for the arm, it extends around more than 50% but less than 80% of the circumference of the arm at the elbow as shown in FIG. 2. The elbow protrudes through a rectangular hole formed by the two edges of the cloth 1 and the two straps, the lower strap 17 and the upper strap 19. (The "upper" end or "top" of the brace is that which is closer to the shoulder when applied and the "lower" end or "bottom" of the brace is that which is closer to the wrist when applied.)

Unlike the prior art brace which has three straps, the invented brace has only two straps, a lower strap 17 and an upper strap 19, so that the elbow can protrude in a gap 18 between the two straps and between the two edges of the sheet of cloth 1. Because the forces applied to the invented brace are greater than in the prior art brace, and because one of the stays 3 presses quite firmly against the skin above and the skin below the inside of the elbow, two or more pads 21 are desirable between the ends of stays and the inner surface of the brace which adjoins the skin when worn.

In the prior art brace, the stay pockets 2 are quite wide compared to the stays 3, allowing the stays to be close to each other or far from each other depending upon happenstance. In the invented brace, stitched seams 15 form the edges of the stay pockets 2. The stitched seams 15 are placed very close to the edges of the primary stays 3 and the third stay 9 to carefully hold them in proper alignment, allowing less than three-eighths of an inch of lateral movement and preferable less than one-eighth of an inch.

When properly applied to the elbow, the bone of the forearm will be pressed against by the span of cloth 13 between the two primary stays 3. Consequently, this span of cloth 13 between the stays must be at least three-quarters of an inch for a child-size brace and up to two inches for an adult-size brace so that cloth will press against the arm bone rather than the end of the stay pressing directly (through the pad and the skin) against the arm bone. Preferably, the span of cloth between the primary stays 3 will narrow toward the top of the brace 11. When the gap between the two primary stays 3 narrows toward the top of the brace (widens toward the bottom of the brace) there is less buckling of the stays and better performance of the brace.

In a preferred embodiment of the brace shown in FIG. 3, the brace includes holes or slits 8 and 28 beside each of the stays. The holes allow desirable flexibility between the stay pockets.

DETAILED DESCRIPTION

Figure 1:
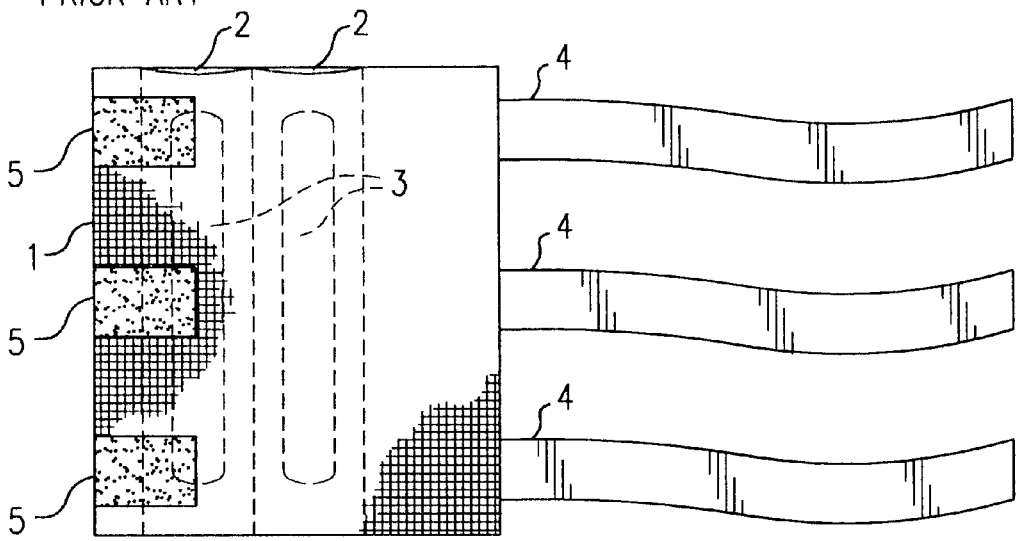
FIG. 1 PRIOR ART
FIG. 1 shows the prior art brace for teaching tennis.
Figure 2:
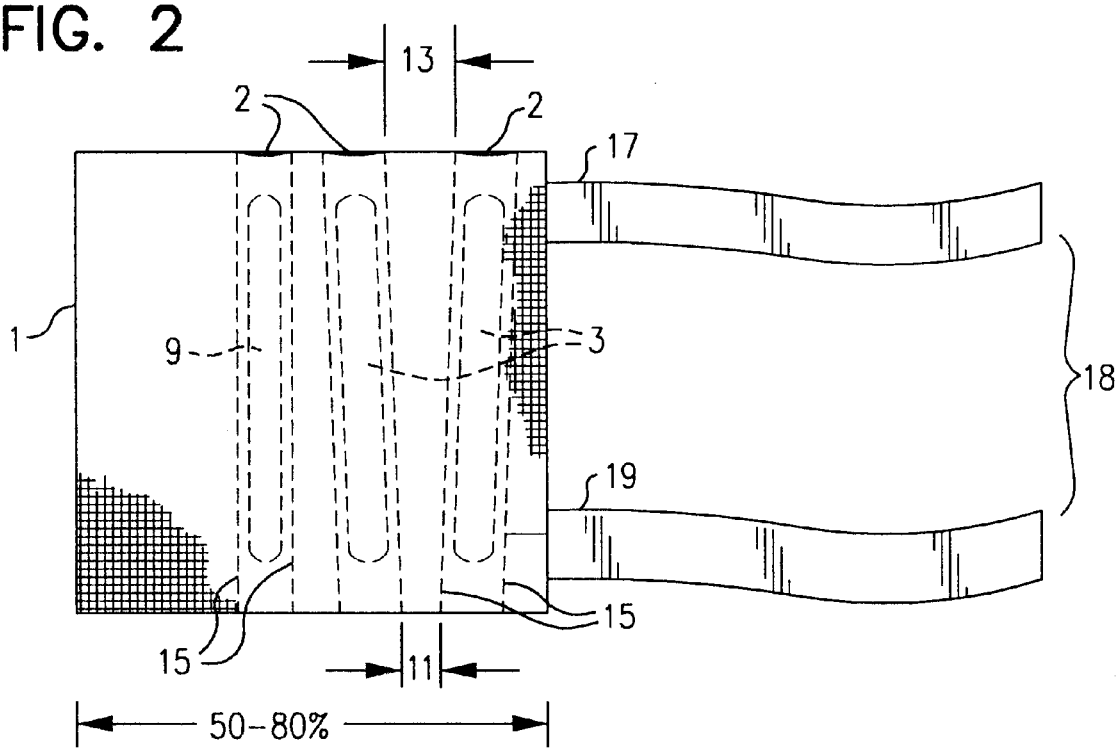
FIG. 2 shows the invented brace.

The primary structure of the brace 1 is preferably made of heavy, tightly woven polyester such as used for belts or back packs. In the first embodiment shown in FIG. 2, it is comprised of one layer folded on itself, to form the pockets 2. The pockets are formed by stitching across the two layers to form seams 15. In the preferred embodiment shown in FIG. 3, the straps 17 and 19 are formed of a layer of belt material stitched to a layer of velcro loops.

At the lower end, the end toward the wrist, the gap between the two primary stays 3 is preferably between ¾ inch and 1¼ inch for children and between 1¼ inch and 1¾ inches for adults. At the upper end, toward the shoulder, the gap is preferably about one half as wide as the gap at the lower end, resulting in a tapered space between the stays. Measuring the distance between the primary stays at the ends of the hole 28, the ratio of the wider end to the narrower end should be between 1.05 and 1.5, preferably about 1.2. The ratio of the length of the hole 28 to the width of the wider end should be between 2.0 and 4.5, preferably about 3.1. The ratio of the length of the hole 28 to the width of the narrower end should be between 1.5 and 4.0, preferably about 2.5.

The stays may be of any stiff but flexible material such as many varieties of plastic, preferably one-sixteenth inch thick polycarbonate, between ¾ inch and 1¾ inches wide and 4–8 inches long for adults and ⅜ inch to 1 inch wide and 3–6 inches long for children. The middle stay is preferably approximately 50% thicker than the other two or is comprised of two stays held together by the surrounding cloth. The stays may be formed by injection molding, in which case it is preferred for them to be connected at their ends by bridging material to form one interconnected piece.

The ends of the lower strap 17 and the upper strap 19 are attached to each other with any of many possible fasteners. The preferred fastener is velcro. Each strap preferably passes through a rigid plastic eye affixed to the opposite end of the strap and then loops back upon itself so that both the hooks and the loops of the velcro are on the strap.

As the locations for the pads 21 are all in a line, the pads are preferably made of a single strip of padding passing under the ends of all of the stays. As the two locations for padding strips lie on straight lines from the two straps 17 and

19, the padding is preferably sown to the strap. The straps 17 and 19 may be cut from laminated material consisting of a woven polyester layer and a foam rubber layer.

The polyester provides the strength and stiffness while the foam rubber provides the padding. Alternatively, a non-skid rubber surface may be achieved on the inside of the straps by spray coating the polyester strap material with a high traction rubberlike material.

Figure 3:
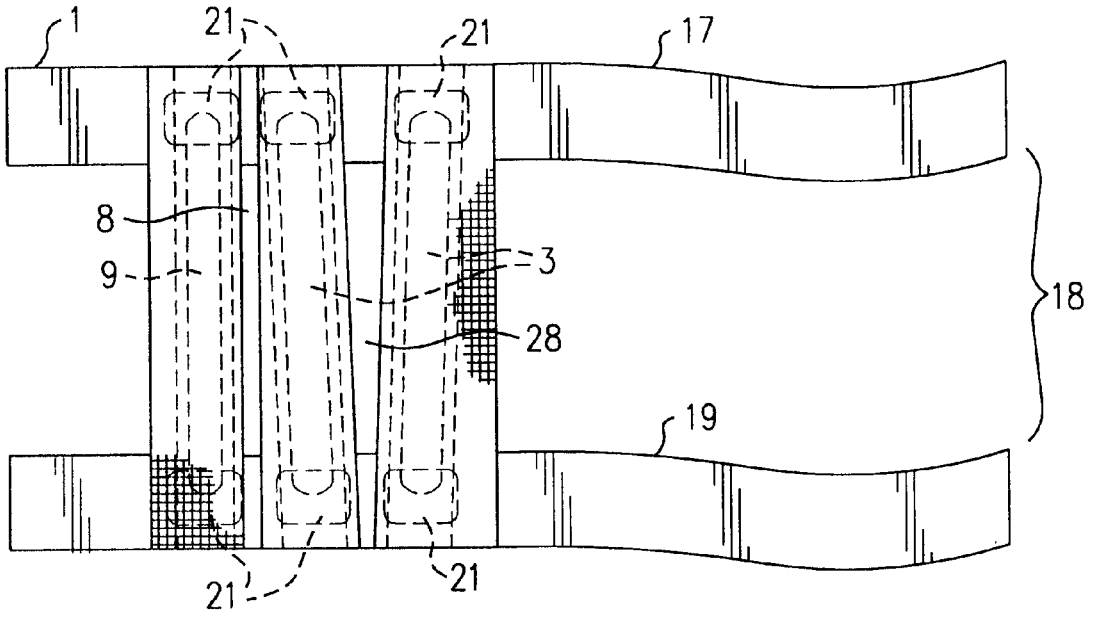
FIG. 3 shows the invented brace with padding at the ends of the stays and with holes beside the stays.

In the model shown in FIG. 3, the holes 8 and 28 may be formed by simply cutting holes in the cloth sheet 1. However, it is preferable to form the holes by sewing together the various structures of cloth to create the desired shape rather than cutting holes in a larger piece of cloth. Specifically, a sheath is made for each the three stays independently. When these three sheaths are sewn to the two straps 17 and 19, the desired structure is formed.

I claim:

1. An elbow brace for teaching throwing comprising:

(a) cloth in a shape adapted to a human arm at an elbow, enclosing two primary stays oriented longitudinally to a circumference, approximately parallel to each other, the stays forming a space between them which tapers to be wider toward an wrist and narrower toward an shoulder;

(b) a first circumferential fastener that encircles the arm above the elbow and a second circumferential fastener that encircles the arm below the elbow, there being no material at the lion of the point of the elbow;

(c) each stay having two ends, a first end attached to the first circumferential fastener and a second end attached to the second circumferential fastener;

(d) a span of cloth spanning the first ends of the stays such that, when the brace is worn and the elbow is bent, the span of the cloth presses through skin against a bone of a forearm, the stays being configured so that the first ends do not press against the bone of the forearm when the elbow is bent;

(e) the stays being flexible enough to allow bending of the elbow yet stiff enough to restrain bending of the elbow.

2. The elbow brace of claim 1 further comprising a third stay having two ends, a first end attached to the first circumferential fastener and a second end attached to the second circumferential fastener, disposed between the two stays, where the third stay is substantially stiffer than the other two.

3. The elbow brace of claim 1 having no circumferential structure between the two circumferential fasteners.

4. The elbow brace of claim 1 where the stays are constrained by surrounding cloth to allow lateral movement of each stay of less than three-eighths of an inch.

5. The elbow brace of claim 4 where the stays are constrained by surrounding cloth to allow lateral movement of each stay of no more than one-eighth of an inch.

6. The elbow brace of claim 1 where a space between stays is between three-quarters of an inch and one and three-quarters of an inch.

7. The elbow brace of claim 6 where a ratio of a width of the space between the stays toward the wrist and a width of the space between the stays toward the shoulder is between 1.05 and 1.5.

8. The elbow brace of claim 1, the circumferential fasteners forming an inside and an outside and having padding disposed on the inside of the ends of the stays.

9. The elbow brace of claim 8 inhere the padding also comprises a non-skid inner surface.

10. The elbow brace of claim 1 having three or more stays where middle stays is substantially stiffer than the other two or more stays.

11. The elbow brace of claim 1, the circumferential fasteners forming an inside and an outside, having a non-skid surface disposed on the inside.

12. An elbow brace for teaching throwing comprising:

(a) cloth in a shape adapted to a human arm at an elbow, enclosing three stays oriented longitudinally to a circumference, approximately parallel to each other;

(b) a circumferential fastener that encircles the arm above the elbow and a circumferential fastener that encircles the arm below the elbow;

(c) each stay having two ends, a first end attached to the circumferential fastener above the elbow and a second end attached to the circumferential fastener below the elbow;

(d) the stays being flexible enough to allow bending of the elbow yet stiff enough to restrain bending of the elbow;

(e) the stays being constrained to allow lateral movement of each stay with respect to the cloth of less than three-eighths of an inch; and (f) the middle stay being substantially stiffer than the other two and having a span of cloth spanning the ends of the middle stay and a stay beside the middle stay below the elbow, the length of the span being between ¾ inch and 1¾ inches, such that, when the brace is worn and the elbow is bent, the span of cloth presses through skin against a bone of a forearm, the stays being configured so that the ends do not press against the bone of the forearm when the elbow is bent, there being no material at the location of the point of the elbow and no circumferential structure between the two circumferential fasteners.

13. The elbow brace of claim 12, the circumferential fasteners forming an inside and an outside and having padding disposed on the inside of the ends of the stays.

14. The elbow brace of claim 13 where the padding also comprises a non-skid inner surface.

15. The elbow brace of claim 12, the circumferential fasteners forming an inside and an outside, having a non-skid surface disposed on the inside.

* * * * *

UNITED STATES PATENT AND TRADEMARK OFFICE

CERTIFICATE OF CORRECTION

PATENT NO. : 6,322,462 B1
DATED : November 27, 2001
INVENTOR(S) : Timothy J. Kafer It is certified that error appears in the above-identified patent and that said Letters Patent is hereby corrected as shown below:

Column 3,
Line 28, "lion" needs to be changed to -- location --

Column 4,
Line 8, "inhere" needs to be changed to -- where --
Line 11, -- the -- inserted after where and before middle Signed and Sealed this Fourteenth Day of May, 2002

*Attest:*

*Attesting Officer*

JAMES E. ROGAN
*Director of the United States Patent and Trademark Office*